US005776668A

United States Patent [19]

Oltean et al.

[11] Patent Number: 5,776,668

[45] Date of Patent: Jul. 7, 1998

[54] ABRASIVE LUBRICATING OVERCOAT LAYERS

[75] Inventors: George Leslie Oltean, Rochester; Mridula Nair, Penfield; Tamara Kay Osburn, Rochester, all of N.Y.

[73] Assignee: Eastman Kodak Company, Rochester, N.Y.

[21] Appl. No.: 724,720

[22] Filed: Sep. 30, 1996

[51] Int. Cl.[6] ..... G03C 11/06; G03C 1/76

[52] U.S. Cl. ..... 430/523; 430/495.1; 430/496; 430/501; 430/140

[58] Field of Search ..... 430/495.1, 496, 430/501, 523, 140

[56] References Cited

U.S. PATENT DOCUMENTS

| | | | |
|---|---|---|---|
| 3,782,947 | 1/1974 | Krall | 430/495.1 |
| 4,279,945 | 7/1981 | Audran et al. | 430/140 |
| 4,990,276 | 2/1991 | Bishop et al. | 252/62.54 |
| 5,254,449 | 10/1993 | James et al. | 430/533 |
| 5,427,900 | 6/1995 | James et al. | 430/496 |
| 5,432,050 | 7/1995 | James et al. | 430/496 |
| 5,434,037 | 7/1995 | Wexler et al. | 430/496 |
| 5,457,012 | 10/1995 | Nair et al. | 430/495 |

FOREIGN PATENT DOCUMENTS 686172 5/1964 Canada .

*Primary Examiner*—Mark F. Huff
*Attorney, Agent, or Firm*—Carl F. Ruoff

[57] ABSTRACT

The present invention describes a photographic element having a support, a light-sensitive layer, a transparent magnetic recording layer and a lubricating/abrasive layer farthest from the support which contains a film-forming binder, lubricant and abrasive particles.

10 Claims, No Drawings

ABRASIVE LUBRICATING OVERCOAT LAYERS

FIELD OF THE INVENTION

This invention relates to an abrasive lubricating overcoat layer for use in an imaging element containing a transparent magnetic layer. This invention also relates to a photographic element having a transparent magnetic layer and an abrasive lubricating overcoat layer.

BACKGROUND OF THE INVENTION

Conventional magnetic recording elements that are used for recording sounds or images are generally opaque to visible light regardless of the nature of the magnetic particles used in such elements. For example, motion picture films often are provided with a magnetic sound track which generally is opaque and does not cover that portion of the film used in the projection of images.

Canadian Patent 686,172 shows that a magnetic recording layer may be transparent to visible light when it contains low concentrations of magnetizable particles. According to this patent, such a layer is coated over a layer containing descriptive material which allows a user to simultaneously hear and see certain subject matter. However, this patent points out that the electromagnetic characteristics, i.e., the magnetic recording and reproducing characteristics, of such a layer are inferior to those of conventional magnetic layers as a result of the very low concentration of magnetizable particles.

U.S. Pat. No. 3,782,947 discloses a photographic product which carries magnetic particles distributed across the image area of the product. The particle distribution and sizes are so designed that the composite granularities of the photographic and magnetic recording media are such that the magnetic distribution is essentially transparent in a photographic sense.

U.S. Pat. No. 4,279,945 discloses a process of preparing magnetic recording elements containing a transparent recording layer. According to this patent, the magnetic recording and reproducing characteristics obtained are comparable to conventional opaque magnetic layers without the need for matching the granularity of a magnetic medium to that of photographic medium. However, the process requires that the layer containing magnetic particles be treated using one or both of the following process steps, (1) compacting the layer while it is in a malleable state to reduce its thickness (e.g., calendaring), or (2) imbibing into the layer a substantially transparent liquid having a refractive index that is substantially the same as that of the binder.

Elements of the type described in the above-cited patent have not achieved widespread commercial success for various reasons. For example, the elements described in U.S. Pat. No. 4,279,945, as indicated by the Figure therein, are substantially opaque at wavelengths less than about 500 nm and thus are not useful in color films. Further, the disclosed process requires that the magnetic recording layer be calendared while it is in a malleable state and/or that a transparent liquid be imbibed into the magnetic recording layer. On the other hand, U.S. Pat. No. 3,782,947 contemplates coating a dispersion containing magnetic particles onto a film base. However, the quantity of solvent required in such a process is unattractive from both an economic and environmental standpoint. Additionally, in continuous wide web coating techniques adapted for commercial manufacturing operations, solvent attack on the film base can render the element unusable, resulting in unacceptable manufacturing inefficiencies and excessive costs. Moreover, it is difficult to prepare magnetic recording layers in such a coating process having a thickness of less than about 5 microns.

U.S. Pat. No. 4,990,276 discloses a dispersion of magnetic particles, a dialkylester of phthalic acid and a dispersing agent. U.S. Pat. No. 5,254,449 discloses the use of such a dispersion to provide a substantially transparent magnetic recording layer in the preparation of a novel photographic element. The process described in this patent calls for dilution of the dispersion with a binder in an organic solvent such as a mixture of methylene chloride and methanol, to form a casting composition. The casting composition is then extruded under pressure onto a photographic support.

U.S. Pat. Nos. 5,427,900 and 5,432,050 describe transparent magnetic recording layers for use in photographic elements wherein organic solvents are used for the preparation of a dispersion containing the magnetic particles.

U.S. Pat. No. 5,457,012 describes a magnetic recording layer which has excellent magnetic characteristics and which is photographically transparent. The stable aqueous dispersion of the magnetic layer comprises a dispersion of magnetic particles in an aqueous medium which contains an anionic dispersant having an HLB (hydrophilic/lypophilic balance) number of at least eight. The dispersant preferably is an amphipathic water-soluble or water-dispersible organic compound. A film-forming binder such as gelatin, or other hydrophilic colloid, in an aqueous medium can be added to the dispersion and the resulting coating composition coated on a support to yield a transparent magnetic layer.

It is evident that providing a photographic element with a magnetic layer of a desired transparency without the use of an organic solvent is desirable. It is also evident that such a layer must be read by a magnetic reader/recorder reliably and consistently.

The photographic element and particularly the transparent magnetic recording layer provided thereon must be capable of repeated use in both the recording and reading mode and, therefore, must be durable, abrasion resistant and scratch resistant so as not to adversely affect the quality of the photographic element. For example, during the residence of the film in a camera, entries may be made to the magnetic recording layer for every exposure, and an indeterminate number of read operations are conducted depending on the particular application to which the film is used. This also is true in the processing of the film and in subsequent use of the processed film for additional copies, enlargements and the like.

It would be highly desirable to provide photographic elements having a transparent magnetic recording layer(s) that demonstrates improved magnetic performance, improved photographic performance, improved running durability and scratch resistance while minimizing the extent to which the element abrades contact surfaces. This goal is extremely difficult to achieve because of the nature and concentration of the magnetic particles required to provide sufficient signal to write and read magnetically stored data. Thus, all of these various characteristics must be considered both independently and cumulatively in order to arrive at a commercially viable photographic element containing a transparent magnetic recording layer that will withstand repeated and numerous passages through the recording and reading zones of a suitable apparatus. Also, because of the curl of the element, primarily due to the photographic layers and core set, the film must be held tightly against the magnetic heads by high pressures in order to maintain film flatness in the recording and reading zone.

Abrasive particles are introduced into the magnetic layer to remove any polymer and wax build-up on the heads and provide a cleaning action. Increased loading of abrasive particles in a coating results in increased abrasivity for the layer which translates into excessive wear of any surface that comes into contact with the coating such as magnetic heads, slitting and cutting knives, and other mechanical parts. It is desirable then to reduce the amount of abrasive used in the magnetic layer since lowering the amount of abrasive is one way of reducing the abrasivity of the layer. But this will lower the available concentration of abrasive particles at the surface causing inefficient head-cleaning. The present invention provides a novel solution to these conflicting desires.

SUMMARY OF THE INVENTION

The present invention provides a photographic element which comprises a photographic support, at least one light-sensitive layer, a transparent magnetic recording layer, and an outermost lubricating/abrasive layer. The lubricating/abrasive layer includes a lubricant, a film-forming binder and abrasive particles having a Moh's scale hardness of at least 6.

DETAILED DESCRIPTION OF THE INVENTION

This invention relates to a lubricating/abrasive overcoat layer for use in a photographic element containing a transparent magnetic recording layer. The lubricating overcoat layer provides superior friction performance while cleaning any magnetic head, thus allowing the magnetic recording layer to be used repeatedly both in the recording mode and the reading mode.

The magnetic layer may comprise, for example, fine ferromagnetic powders such as ferromagnetic, gamma, iron oxides, Coldwell surface treated ferromagnetic iron oxides, cobalt doped ferromagnetic iron oxides, cobalt-containing $Fe_2O_3$, ferromagnetic magnitites, cobalt-containing ferromagnetic magnitites, ferromagnetic chromium dioxides, ferromagnetic metal powders, ferromagnetic iron powders, ferromagnetic alloy powders and the class of ferromagnetic ferrite powders, including barium ferrites. Additionally, the above-mentioned powder particles may be modified to provide lower light extinction and scattering coefficients by providing them with a shell of at least the same volume of the magnetic core, of a lower refractive index material that has its refractive index lower than the transparent polymeric material used to form the magnetizable layer. Typical shell materials may include amorphous silica, vitreous silica, glass, calcium fluoride, magnesium fluoride, lithium fluoride, polytetrafluoroethylene and fluorinated resins. Examples of the ferromagnetic alloy powders include those comprising at least 75% by weight of the weight of the metals which comprise at least 80% by weight of at least one ferromagnetic metal alloy (such as Fe, Co, Ni, Fe—Co, Fe—Ni, Co—Ni, Co—Ni—Fe) and 20% or less of other components such as Al, Si, S, Sc, Di, V, Cr, Mn, Cu, Zn, Y, Mo, Rh, Re, Pd, Ag, Sn, B, Ba, Ta, W, Au, Hg, Pb, La, Ce, Pr, Nb, Te, and Bi. The ferromagnetic materials may contain a small amount of water, hydroxide or an oxide. In addition, magnetic oxides with a thicker layer of lower refractive index oxide or other material having a lower optical scattering cross-section as taught by U.S. Pat. No. 5,252,444 may also be used. In addition, U.S. Pat. No. 5,457,012 describes a stable aqueous dispersion of magnetic particles. This dispersion is particularly useful for forming a transparent magnetic layer on a photographic support.

The dispersion contains magnetic particles which preferably are acicular or needle like magnetic particles. The average length of these particles along the major axis preferably is less than about 0.3, more preferably, less than about 0.2 micron. The particles preferably exhibit an axial ratio, that is, a length to diameter thickness ratio of up to about 5 or 6 to 1. Preferred particles have a specific surface area of at least 30 $m^2/g$, more preferably of at least 40 $m^2/g$. Typical acicular particles of this type include for example, particles of ferro and ferro iron oxides such as gamma-ferric oxide, complex oxides of iron and cobalt, various ferrites and metallic iron pigments. Alternatively, small tabular particles such as barium ferrites and the like can be employed. The particles can be doped with one or more ions of a polyvalent metal such as titanium, tin, cobalt, nickel, zinc, maganese, chromium, or the like as is known in the art.

A preferred particle consists of Co surface treated $\gamma$-$Fe_2O_3$ having a specific surface area of greater than 40 $m^2/g$. Particles of this type are commercially available and can be obtained from Toda Kogyo Corporation under the trade names CSF 4085V2, CSF 4565V, CSF 4585V and CND 865V and are available on a production scale from Pfizer Pigments Inc. under the trade designations RPX-4392, RPX-5003, RPX-5026 and RPX-5012. For good magnetic recording, the magnetic particles preferably exhibit coercive force above about 500 Oe and saturation magnetization above 70 emu/g.

The primary utility for transparent magnetic recording layers is in the photographic industry wherein a photographic film can be built onto a substrate that includes a transparent recording layer. The transparent magnetic recording layer may be disposed in any position relative to the various layers of the photographic film including over the light sensitive layers, within the layers, within the base substrate. One suitable technique would be to prepare the substrate for the film whether it be cellulose acetate, polyethylene terephthalate, polycarbonate paper or other suitable substrate for that purpose with a transparent magnetic recording layer on one surface thereof. This again can be achieved either by coating applications widely known in both the photographic and magnetic recording fields of technology. Information can then be encoded into the magnetic layer during all steps of the preparation of the photographic product. This can include manufacturing data with regard to the various layers that are employed during the preparation of the film, information with regard to the properties of the various layers built onto the substrate and the like. Further, after the film is completed and is being used by the consumer, many and various applications can be envisioned wherein information is included in the magnetic layer that is helpful to the photographer, the developing laboratory and others engaged in this field of endeavor. For example, when a camera also has the capability of imparting data to a magnetic layer by having built in recording heads in the camera, information with regard to each frame of the film can be recorded, such as, the light conditions, the speed at which the frame is exposed, the F-Stop number and the like.

Transparent magnetic layers can be prepared by applying a coating composition prepared either in an organic solvent as described in U.S. Pat. No. 4,990,276 or in water by dispersing the magnetic particles in an aqueous medium containing a hydrophilic binder using a dispersing agent. A dispersing agent, sometimes referred to as a wetting agent of surface active agent can be present in the dispersion to facilitate dispersion of the magnetic particles and/or filler particles with the dispersing medium. Suitable dispersing agents are described in U.S. Pat. No. 5,457,012. Examples of hydrophilic binders which can be used are those described in Research Disclosure No. 308119, December 1989, and No. 18716 (page 651) November 1979. Illustrative hydrophilic binders include water-soluble polymers, gelatin, gelatin derivatives, cellulose esters, latex derivatives, casein, agar, sodium alginate, starch, polyvinyl alcohol, polyacrylic acid copolymers and maleic anhydride copolymers and mixtures thereof. The cellulose esters include hydroxyl propyl cellulose, carboxymethyl cellulose and hydroxyethyl cellulose. The latex polymers include vinyl chloride copolymers, vinylidene chloride copolymers, acrylic ester copolymers, vinyl acetate copolymers and butadiene copolymers. Among them, gelatin is most preferred.

Gelatin may be any of so-called alkali-treated (lime treated) gelatin which was immersed in an alkali bath, prior to extraction thereof, an acid-treated gelatin which was immersed in an alkali bath prior to extraction thereof, an acid-treated gelatin which was immersed in both baths and enzyme-treated gelatin. If necessary, gelatin can be used in combination with colloidal albumin, casein, a cellulose derivative (such as carboxymethyl or hydroxyethyl cellulose), agar, sodium alginate, a saccharide derivative (such as a starch derivative or dextran), a synthetic hydrophilic colloid (such as polyvinyl alcohol, poly-N-vinylpyrolidone, a polyacrylic acid copolymer, polyacrylamide or a derivative or partial hydrolyzate thereof) or a gelatin derivative.

The above described coating composition containing the dispersed magnetic particles, dispersant and film-forming hydrophilic binder is coated onto a suitable support either as is or along with additional or optional ingredients such as, crosslinking or hardening agents, coating aids, abrasive particles, lubricants, matting agents, antistatic agents, fillers and the like, before the coating operation.

The coating composition is applied to a suitable support which may contain additional layers for promoting adhesion, by any suitable coating device including slot die hoppers, gravure coaters, reverse roll coaters and the like. The thickness of the magnetic layer preferably should be about 0.5 to about 10 μm, more preferably about 0.5 to about 5 μm and most preferably about 1 to about 3 μm.

The magnetic layer can also be overcoated with conventional layers including antistats, protective overcoats, lubricants and the like.

Any suitable support may be employed in the practice of this invention, such as, cellulose derivatives including cellulose diacetate, cellulose triacetate, cellulose propionate, cellulose butyrate, cellulose acetatepropionate and the like; polyamides; polycarbonates; polyesters, particularly polyethylene terephthalate, poly-1,4-cyclohexanedimethylene terephthalate, polyethylene 1, 2-diphenoxyethane-4,4'-dicarboxylate, polybutylene terephthalate and polyethylene naphthalate; polystyrene, polypropylene, polyethylene, polymethyl-pentene, polysulfone, polyethersulfone, polyarylates, polyether imides and the like. Supports for photographic elements are described in Research Disclosure, December 1989, Item 308,119 published by Kenneth Mason Publications, Ltd., Dudley Annex, 12a North Street, Emsworth, Hampshire P010 7DQ, England, section XVII, incorporated herein by reference.

Particularly preferred supports are polyethylene terephthalate, polyethylene naphthalate and the cellulose esters particularly cellulose triacetate.

Thickness of those supports used in the present invention is from 50 μm to 180 μm, preferably, 85 to 125 microns. In addition, various dyes may be formulated into the support or the magnetic layer to give neutral density.

Depending upon the nature of the support, suitable transparent subbing or undercoat layers may be desired. Particularly with regard to polyester supports, primers are used in order to promote adhesion. Any suitable primers in accordance with those described in the following U.S. patents may be employed: U.S. Pat. Nos. 2,627,088; 3,501,301; 4,689,359; 4,363,872; and 4,098,952. Each of these is incorporated herein by reference in their entirety.

The magnetic recording layer containing gelatin or other hydrophilic colloid is preferably hardened.

Hardeners usable for hardening the magnetic recording layer include, for example, aldehyde compounds such as formaldehyde and glutaraldehyde; ketone compounds such as diacetyl and cyclopentanedione; compounds having reactive halogens such as bis(2-chloroethylurea), 2-hydroxy-4, 6-dichloro-1,3,5-trizine and those described in U.S. Pat. Nos. 3,288,775 and 2,732,303 and British Patent Nos. 974,723 and 1,167,207; divinylsulfone, 5-acetyl-1,3-diacrylolhexahydro-1,3,5-triazine and reactive olefin-containing compounds such as divinylsulfone, 5-acetyl-1,2-diacryloyl-hexahydro-1,3,5-triazine, and the compounds such as divinylsulfone, 5-acetyl-1,3-diacryloyl-hexahydro-1,3,5-triazine, and the compounds disclosed in U.S. Pat. Nos. 3,635,718 and 3,232,763, and British Patent 994,869; N-hydroxymethylothalimide; N-methylol compounds such as N-hydroxymethylphthalimide and those described in U.S. Pat. Nos. 2,732,316 and 2,586,168; isocyanates described in U.S. Pat. Nos. 3,103,437; the aziridines disclosed in U.S. Pat. Nos. 3,017,280 and 2,983,611; acid derivatives described in U.S. Pat. Nos. 2,725,294 and 2,725,295; epoxy compounds described in U.S. Pat. No. 3,091,537; and halogenated carboxyaldehydes such as mucochloric acid. Examples of inorganic hardeners include chrome alum, zirconium sulfate and the carboxyl group activating hardeners described in Japanese Patent Publication for opposition purpose (herein after referred to as J.P. Kokoku) Nos. 56-12853 and 58-32699, Belgian Patent No. 825,726, J.P. Kokai Nos. 60-225148 and 51-126125, J.P. Kokoku No. 58-50699, J.P. Kokai No. 52-54427 and U.S. Pat. No. 3,321,313.

The hardener is generally used in an amount of from 0.01 to 30 weight %, preferably from 0.05 to 20 weight %, to the amount of dried gelatin.

As mentioned above, additional ingredients can be included in the coating composition described above. In certain embodiments of the invention, the coating composition (and thus, the magnetic layer) contains abrasive particles, reinforcing fillers or tin oxide.

Examples of reinforcing filler particles include nonmagnetic inorganic powders with a Moh's scale hardness of at least 6. Specific examples are metal oxides such as γ-aluminum oxide, chromium oxide, (e.g., $Cr_2O_3$), iron oxide (e.g., alpha-$Fe_2O_3$), tin oxide, doped tin oxide, such as antimony or indium doped tin oxide, silicon dioxide, alumino-silicate and titanium dioxide, carbides such as silicon carbide and titanium carbide; and diamond in fine powder. γ-Aluminum oxide and silicone dioxide are preferred. These can also be pre-dispersed in water using the same dispersants as described and then incorporated into the coating composition.

Tin oxide particles in any form may be employed such as tin oxide per se or doped tin oxides, such as, antimony or indium doped tin oxide. The tin oxide may be used in either the conductive or non-conductive form; however, when in the conductive form, an additional advantage is gained in that the layer also acts as an antistat. Suitable conductive particles are disclosed in U.S. Pat. Nos. 4,495,276; 4,394,441; 4,431,764; 4,418,141 and 4,999,276 incorporated herein by reference. Useful tin oxide particles are commercially available from Keeling and Walker, Ltd. under the trade designation Stanostat CPM 375; DuPont Co. under the trade designation Zelec-ECP 3005XC and 3010SC and Mitsubishi Metals Corp. under the trade designation T-1. These can be also be pre-dispersed in water and then incorporated into the coating composition.

As noted, photographic elements in accordance with this invention comprise at least one photosensitive layer. Such photosensitive layers can be image-forming layers containing photographic silver halides such as silver chloride, silver bromide, silver bromoiodide, silver chlorobromide and the like. Both negative and reversal silver halide elements are contemplated. For reversal films, the emulsion layers as taught in U.S. Pat. No. 5,236,817, especially Examples 16 and 21, are particularly suitable. Any of the known silver halide emulsion layers, such as those described in Research Disclosure, Vol. 176, December 1978 Item 17643 and Research Disclosure Vol. 225, January 1983 Item 22534, the disclosures of which are incorporated by reference in their entirety, are useful in preparing photographic elements in accordance with this invention. Generally, the photographic element is prepared by coating the support film on the side opposite the magnetic recording layer with one or more layers comprising a dispersion of silver halide crystals in an aqueous solution of gelatin and optionally one or more subbing layers, such as, for example, gelatin, etc. The coating process can be carried out on a continuously operating machine wherein a single layer or a plurality of layers are applied to the support. For multicolor elements, layers can be coated simultaneously on the composite support film as described in U.S. Pat. No. 2,761,791 and U.S. Pat. No. 3,508,947. Additional useful coating and drying procedures are described in Research Disclosure, Vol. 176, December 1978, Item 17643. Suitable photosensitive image forming layers are those which provide color or black and white images.

As is taught in U.S. Pat. No. 3,782,947 noted above, whether an element is useful for both photographic and magnetic recording depends on both the size distribution and concentration of the magnetic particles and on the relationship between the granularities of the magnetic and photographic coatings. Generally, of course, the coarser the grain of the emulsion in the photographic element that contains the magnetic recording layer, the larger the mean size of the magnetic particles which can be tolerated. A magnetic particle concentration between about 10 and 1000 mg/m$^2$ when uniformly distributed across the desired area of the photographic element will be sufficiently photographically transparent provided that the maximum particle size is less than about 1 micron. Particle concentrations less than about 10 mg/m$^2$ tend to be insufficient for magnetic recording purposes and particle concentrations greater than about 1000 mg/m$^2$ tend to be too dense for photographic purposes. Particularly useful particle concentrations are in the range of 20–70 mg/m$^2$. Concentrations of about 20 mg/m$^2$ have been found to be particularly useful in reversal films and concentrations of about 40 mg/m$^2$ are particularly useful in negative films.

The photographic elements according to this invention can contain one or more conducting layers such as antistatic layers and/or anti-halation layers such as such as described in Research Disclosure, Vol. 176, December 1978, Item 17643 to prevent undesirable static discharges during manufacture, exposure and processing of the photographic element. Antistatic layers conventionally used in color films have been found to be satisfactory for use herewith. Any of the antistatic agents set forth in U.S. Pat. No. 5,147,768, which is incorporated herein by reference may be employed. Preferred antistats include metal oxides, for example, tin oxide, antimony doped tin oxide, zinc antimonate and vanadium pentoxide.

The photographic elements according to this invention must be provided with a lubricating/abrasive layer, such as a wax/abrasive layer, over the transparent magnetic recording layer. The lubricating/abrasive layer includes a transparent polymeric binder, lubricant and abrasive particles. Suitable lubricants include silicone oil, silicones having polar groups, fatty acid-modified silicones, fluorine-containing silicones, fluorine-containing alcohols, fluorine-containing esters, polyolefins, polyglycols alkyl phosphates and alkali metal salts thereof, alkyl sulfates and alkali metal salts thereof, polyphenyl ethers, fluorine-containing alkyl sulfates and alkali metal salts thereof, monobasic fatty acids having 10 to 24 carbon atoms (which may contain unsaturated bonds or may be branched) and metal salts thereof (such as Li, Na, K and Cu), monovalent, divalent, trivalent, tetravalent, pentavalent and hexavalent alcohols having 12 to 22 carbon atoms (which may contain unsaturated bonds or may be branched), alkoxy alcohols having 12 to 22 carbon atoms, mono-, di- and tri-esters of monobasic fatty acids having 10 to 24 carbon atoms (which may contain unsaturated bonds or may be branched) and one of monovalent, divalent, trivalent, tetravalent, pentavalent and hexavalent alcohols having 2 to 12 carbon atoms (which may contain unsaturated bonds or may be branched), fatty acid esters of monoalkyl ethers of alkylene oxide polymers, fatty acid amides having 8 to 22 carbon atoms and aliphatic amines having 8 to 22 carbon atoms.

Specific examples of these compounds (i.e., alcohols, acids or esters) include lauric acid, myristic acid, palmitic acid, stearic acid, behenic acid, butyl stearate, oleic acid, linolic acid, linolenic acid, elaidic acid, octyl stearate, amyl stearate, isooctyl stearate, octyl myristate, carnauba wax, butoxyethyl stearate, anhydrosorbitan monostearate, anhydrosorbitan distearate, anhydrosorbitan tristearate, pentaerythrityl tetrastearate, oleyl alcohol and lauryl alcohol. Carnauba wax is preferred.

Examples of abrasive particles useful in the lubricant/abrasive overcoat layer of the present invention include nonmagnetic inorganic powders with a Moh's scale hardness of not less than 6. Specific examples are metal oxides such as alpha aluminum oxide, chromium oxide (e.g., $Cr_2O_3$), iron oxide alpha (e.g., $Fe_2O_3$), silicon dioxide, alumino-silicate and titanium carbide; carbides such as silicon carbide and titanium carbide; nitrides such as, silicon nitride, titanium nitride and diamond in fine powder. Alpha alumina and silicon dioxide are the preferred abrasives in accordance with this invention. These can be pre-dispersed in water and incorporated into the coating composition.

Examples of hydrophilic binders which can be used are those described in Research Disclosure No. 308119, December 1989, and No. 18716 (page 651) November 1979. Illustrative hydrophilic binders include water-soluble polymers, gelatin, gelatin derivatives, cellulose esters, latex derivatives, casein, agar, sodium alginate, starch, polyvinyl alcohol, polyacrylic acid copolymers and maleic anhydride copolymers and mixtures thereof. The cellulose esters include hydroxyl propyl cellulose, carboxymethyl cellulose and hydroxyethyl cellulose. The latex polymers include vinyl chloride copolymers, vinylidene chloride copolymers, acrylic ester copolymers, vinyl acetate copolymers and butadiene copolymers. Other suitable binders include aqueous emulsions of addition-type polymers and interpolymers prepared from ethylenically unsaturated monomers such as acrylates including acrylic acid, methacrylates including methacrylic acid and acrylamides and methacrylamides, itaconic acid and its half esters and diesters, styrenes including substituted styrenes, acrylonitrile, methacrylonitrile, vinyl acetates, vinyl ethers, vinyl and vinylidene halides and olefins and aqueous dispersions of polyurethanes and polyesterionomers. Among them, gelatin and polyurethanes are most preferred.

Gelatin may be any of so-called alkali-treated (lime treated) gelatin which was immersed in an alkali bath, prior to extraction thereof, an acid-treated gelatin which was immersed in an alkali bath prior to extraction thereof, an acid-treated gelatin which was immersed in both baths and enzyme-treated gelatin. If necessary, gelatin can be used in combination with colloidal albumin, casein, a cellulose derivative (such as carboxymethyl or hydroxyethyl cellulose), agar, sodium alginate, a saccharide derivative (such as a starch derivative or dextran), a synthetic hydrophilic colloid (such as polyvinyl alcohol, poly-N-vinylpyrolidone, a polyacrylic acid copolymer, polyacrylamide or a derivative or partial hydrolyzate thereof) or a gelatin derivative.

The above described coating composition containing the abrasive particles, dispersant, lubricant and film-forming hydrophilic binder is coated above a transparent magnetic layer either as is or along with additional or optional ingredients such as, crosslinking or hardening agents, coating aids, matting agents, fillers and the like, before the coating operation.

The following examples illustrate the preparation of a lubricating abrasive overcoat for use with transparent magnetic recording layers in accordance with the present invention.

EXAMPLES

Examples showing the abrasive/wax/binder overcoat combinations.

EXAMPLES 1 to 3 (Comparative)

Comparative coatings of abrasive particles in a magnetic layer were prepared as described in U.S. Pat. No. 5,531,913, the layer compositions for which are described in Table 1. All three coatings contained 66.6 mg/m$^2$ TL502 (National Starch Chemical Co., polystyrene sulfonic acid sodium salt). These had varying levels of AKP 50 abrasive particles and were overcoated with Carnauba wax (MIChem Lube 160, Michelman) in the amount specified in Table 1.

EXAMPLES 4–5 (Comparative)

These examples show the effect of a binder/carnauba wax overcoat on a magnetic layer both with and without abrasive particles. The layer compositions are shown in Table 1.

EXAMPLES 6–13 (Invention)

In these examples the magnetic layer contains no abrasive particles and the lubricant layer does. The levels of lubricant, binder and abrasive particles in the examples were varied as shown in Table 1. The binder in all the lubricant overcoats in examples 6–11 was gelatin and the binder in the overcoats described in 12 and 13 was Witco Bond W232 polyurethane (available from Witco Corporation).

TABLE 1

| | LEVELS in mg/m$^2$ | | | | |
|---|---|---|---|---|---|
| | Magnetic Layer[1] | | Lubricant Layer | | |
| EXAMPLES | Binder | Abrasive | Abrasive | Wax[2] | Binder[3] |
| 1 | 1211 | 59.2 | 0 | 47.8 | 0 |
| 2 | 1211 | 32.3 | 0 | 47.8 | 0 |
| 3 | 1211 | 10.8 | 0 | 47.8 | 0 |
| 4 | 1352 | 59.2 | 0 | 129.2 | 64.6 |
| 5 | 1211 | 0 | 0 | 129.2 | 64.6 |
| 6 | 1211 | 0 | 10.8 | 129.2 | 64.6 |
| 7 | 1211 | 0 | 32.3 | 129.2 | 64.6 |
| 8 | 1211 | 0 | 10.8 | 64.6 | 64.6 |
| 9 | 1211 | 0 | 32.3 | 64.6 | 64.6 |
| 10 | 1211 | 0 | 10.8 | 64.6 | 129.2 |
| 11 | 1211 | 0 | 32.3 | 64.6 | 129.2 |
| 12 | 1211 | 0 | 10.8 | 64.6 | 64.6* |
| 13 | 1211 | 0 | 10.8 | 64.6 | 129.2* |

* Witco Bond W232

[1]The magnetic layer in all examples has 59.2 mg/m$^2$ of γ-iron oxide (Toda CSF-4085V2)

[2]Carnauba wax as described in Example 1–3

[3]All gelatin containing layers were hardened with bis-vinyl sulfonyl methyl ether

Evaluation Methods

The frictional behavior, dynamic and static coefficients of friction and surface durability of all the coatings, Examples 1–13, were measured using a pin-on-disc friction tester and a rotating drum friction tester. The results are presented in Table 2. The performance/durability ratings shown in Table 2 are based on the rotating drum friction test. The rank ordering fair, satisfactory, good and excellent corresponds to increasing levels of overall performance over a ten-minute test. Excellent corresponds to no stick-slip behavior and no change in the low running friction over the ten-minute test. Fair corresponds to somewhat heavy stick-slip behavior and increasing running friction over the ten-minute test.

Examples 1–3 show that lowering the concentration of abrasive particles in the magnetic layer can eventually lower the overall performance and increase the initial and final friction coefficients. Example 4 shows that the performance is not affected much if a gelatin/wax overcoat is substituted for the wax only overcoat. Example 5 shows that the absence of abrasive particles in the magnetic layer causes the running friction to go up with time and the performance decreases. Examples 6–11 show improved performance results when the abrasive particles are moved from the magnetic layer to the wax/binder layer even at lower levels of the abrasive particles as in Examples 6, 8 and 10. Examples 12 and 13 show that similar excellent results are achieved when the gelatin binder is replaced with a polyurethane binder.

It is preferred that the abrasive particles are present in an amount of from 5 to 75 percent based on the weight of the film forming binder. It is preferred that the abrasive particles are present in an amount of from 0.5 mg/m$^2$ to 100 mg/m$^2$ It is also preferred that the abrasive particles are present in an amount of from 6 to 55 percent by weight of the lubricant.

TABLE 2

| Abrasive Lubricating Overcoat Layers | | | |
|---|---|---|---|
| Patent Example | Initial Friction | Running Friction | Performance/ Durability |
| 1 | 0.24 | 0.13 | good |
| 2 | 0.22 | 0.12 | good |
| 3 | 0.3 | 0.3 | satisfactory |
| 4 | 0.21 | 0.12 | good |
| 5 | 0.19 | 0.27 | fair |
| 6 | 0.22 | 0.09 | excellent |
| 7 | 0.21 | 0.05 | excellent |
| 8 | 0.21 | 0.09 | excellent |
| 9 | 0.22 | 0.08 | excellent |
| 10 | 0.21 | 0.15 | good |
| 11 | 0.20 | 0.10 | good |
| 12 | 0.19 | 0.09 | excellent |
| 13 | 0.17 | 0.07 | excellent |

The invention has been described in detail with particular reference to certain preferred embodiments thereof, but it will be understood that variations and modifications can be effected within the spirit and scope of the invention.

What is claimed is:

1. A photographic element comprising:

a photographic support, at least one light-sensitive layer, a transparent magnetic recording layer containing magnetic particles; and an outermost lubricating layer comprising a lubricant, a water-dispersible polymer as a film-forming binder, and abrasive particles having a Moh's scale hardness of at least 6.

2. The photographic element of claim 1, wherein the lubricant is selected from the group consisting of silicone oil, silicones having polar groups, fatty acid modified silicones, fluorine-containing silicones, fluorine-containing alcohols, fluorine-containing esters, polyolefins, polyglycols, alkyl phosphates, alkali metal salts of alkyl phosphates, alkyl sulfates, alkali metal salts of alkyl sulfates, polyphenyl ethers, fluorine-containing alkyl sulfates, alkali metal salts of fluorine-containing alkyl sulfates, monobasic fatty acids having 10 to 24 carbon atoms, metal salts of monobasic fatty acids having 10 to 24 carbon atoms, monovalent, divalent, trivalent, tetravalent, pentavalent of hexavalent alcohols having 1 to 22 carbon atoms, alkoxy alcohols having 12 to 22 carbon atoms; mono, di, or tri-esters of monobasic fatty acids having 10–24 carbon atoms; fatty acid esters of monoalkyl ethers of alkylene oxide polymers, carnauba wax, fatty acid amides having 8 to 22 carbon atoms, and aliphatic amines having 8 to 22 carbon atoms.

3. The photographic element of claim 1, wherein the abrasive particles are selected from the group consisting of metal oxides, nitride and carbides.

4. The photographic element of claim 1, wherein the abrasive particles comprise alpha aluminum oxide.

5. The photographic element of claim 1, wherein the abrasive particles are present in an amount of 0.5 to 100 $mg/m^2$.

6. The photographic element of claim 1, wherein the abrasive particles are present in amount of from 5 to 75 percent based on weight of the film-forming binder.

7. The photographic element of claim 1 wherein the abrasive particles are present in an amount of from 6 to 55 percent based on the weight of the lubricant.

8. The photographic element of claim 1, wherein the film-forming binder comprises gelatin.

9. The photographic element of claim 1, further comprising an electrically-conductive layer.

10. The photographic element of claim 1, wherein the magnetic particles exhibit a coercive force of about 500 Oe.

* * * * *